US011840438B2

(12) United States Patent
Krentz et al.

(10) Patent No.: US 11,840,438 B2
(45) Date of Patent: Dec. 12, 2023

(54) PALLET TRANSPORTATION

(71) Applicant: Besser Company, Alpena, MI (US)

(72) Inventors: Douglas Krentz, Alpena, MI (US); Caleb Myers, Lincoln, MI (US)

(73) Assignee: Besser Company, Alpena, MI (US)

( * ) Notice: Subject to any disclaimer, the term of this patent is extended or adjusted under 35 U.S.C. 154(b) by 0 days.

(21) Appl. No.: 17/702,052

(22) Filed: Mar. 23, 2022

(65) Prior Publication Data

US 2022/0306441 A1 Sep. 29, 2022

Related U.S. Application Data

(60) Provisional application No. 63/165,466, filed on Mar. 24, 2021.

(51) Int. Cl.

| | |
|---|---|
| ***B66F 9/18*** | (2006.01) |
| ***B66F 9/08*** | (2006.01) |
| ***B66F 9/14*** | (2006.01) |

(52) U.S. Cl.

CPC ..... *B66F 9/18* (2013.01); *B66F 9/085* (2013.01); *B66F 9/142* (2013.01)

(58) Field of Classification Search

CPC .. B66F 9/08; B66F 9/085; B66F 9/142; B66F 9/18; B65G 1/14

See application file for complete search history.

(56) References Cited

U.S. PATENT DOCUMENTS

| | | | | |
|---|---|---|---|---|
| 4,180,987 | A * | 1/1980 | McLaughlin | A23L 3/362 100/325 |
| 6,223,911 | B1 * | 5/2001 | Weaver | B65G 1/14 211/150 |
| 2005/0035691 | A1 * | 2/2005 | Strobel | B65G 1/14 312/42 |
| 2011/0139546 | A1 * | 6/2011 | Look | B66F 9/085 187/237 |
| 2013/0092477 | A1 * | 4/2013 | Hannemann | B66F 9/12 187/222 |
| 2014/0305741 | A1 * | 10/2014 | Jowett | B65D 71/0096 187/233 |
| 2015/0000608 | A1 * | 1/2015 | Zanotti | B60P 3/04 119/401 |
| 2019/0023297 | A1 * | 1/2019 | Torrison | B62B 1/142 |
| 2019/0077602 | A1 * | 3/2019 | Giachero | B65G 1/14 |
| 2020/0095073 | A1 * | 3/2020 | Kreft | B65G 1/14 |
| 2020/0354206 | A1 * | 11/2020 | Hisada | B66F 9/085 |
| 2020/0385253 | A1 * | 12/2020 | Maurer | B66F 9/205 |
| 2021/0362991 | A1 * | 11/2021 | Wan | B66C 1/32 |

FOREIGN PATENT DOCUMENTS

| | | | | |
|---|---|---|---|---|
| DE | 102022106968 | A1 * | 9/2022 | B66F 9/085 |

* cited by examiner

*Primary Examiner* — Kaitlin S Joerger
(74) *Attorney, Agent, or Firm* — Mechanicus PLLC

(57) ABSTRACT

A pallet transportation apparatus including a pallet support array supported on a pallet transportation chassis for reciprocal motion and comprising pallet supporters that receive and support pallets. A mast assembly is fixed to the chassis and includes guides that support and guide the pallet support array through a reciprocal lifting and lowering motion, causing the pallet support array to lift and lower pallets. A prime mover moves the pallet support array through its reciprocal lifting and lowering motion, and a motion control system schedules the reciprocal lifting and lowering motion of the pallet support array.

19 Claims, 6 Drawing Sheets

PALLET TRANSPORTATION

BACKGROUND

Field

This application relates generally to pallet transporters.

Description of Related Art Including Information Disclosed Under 37 CFR 1.97 and 1.98

Various devices are commonly used to move and store pallets carrying materials, workpieces, or products around or between factory work stations and storage areas. These transporters generally retrieve and deposit pallets by alternately lifting the pallets for transport, and lowering them onto support surfaces in desired locations for storage or use. This alternate lifting and lowering capacity is typically provided via a hydraulic cylinder or a jack-screw/ball-jack. Depending on the application, a pallet transporter may be required to handle wide variations in the number of pallets that must be moved, and to accommodate the weight/fragility of each pallet's payload.

SUMMARY

A pallet transportation apparatus rests on a mobile pallet transportation chassis. A crawler motor is configured to move the chassis across a surface. A pallet support array supports the pallet transportation chassis for reciprocal motion relative to the chassis and comprises pallet supporters spaced and shaped to receive and support pallets. A mast assembly is fixed to the chassis and includes guides shaped to support and guide the pallet support array through a reciprocal lifting and lowering motion causing the pallet support array to lift and lower any pallets positioned to be carried by the pallet supporters. A prime mover is carried by the chassis and operatively connected to the pallet supporter array. The prime mover is configured to move the pallet support array through its reciprocal lifting and lowering motion. A motion control system is connected to the prime mover and configured to schedule the reciprocal lifting and lowering motion of the pallet support array.

DRAWING DESCRIPTIONS

DETAILED DESCRIPTION

Figure 1:
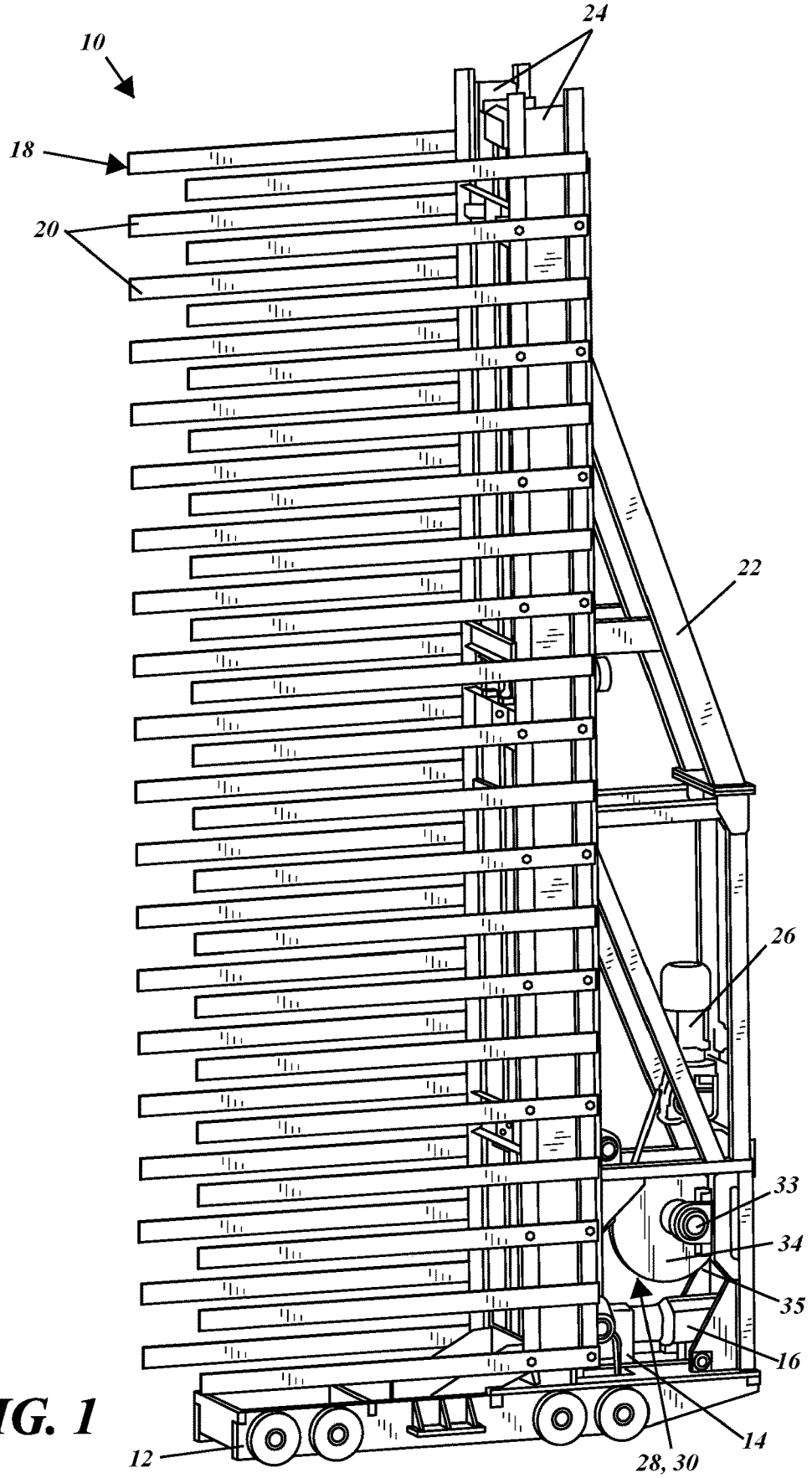
FIG. 1 is a side perspective view of a pallet transportation apparatus comprising a rotary cam motion control system.
Figure 2:
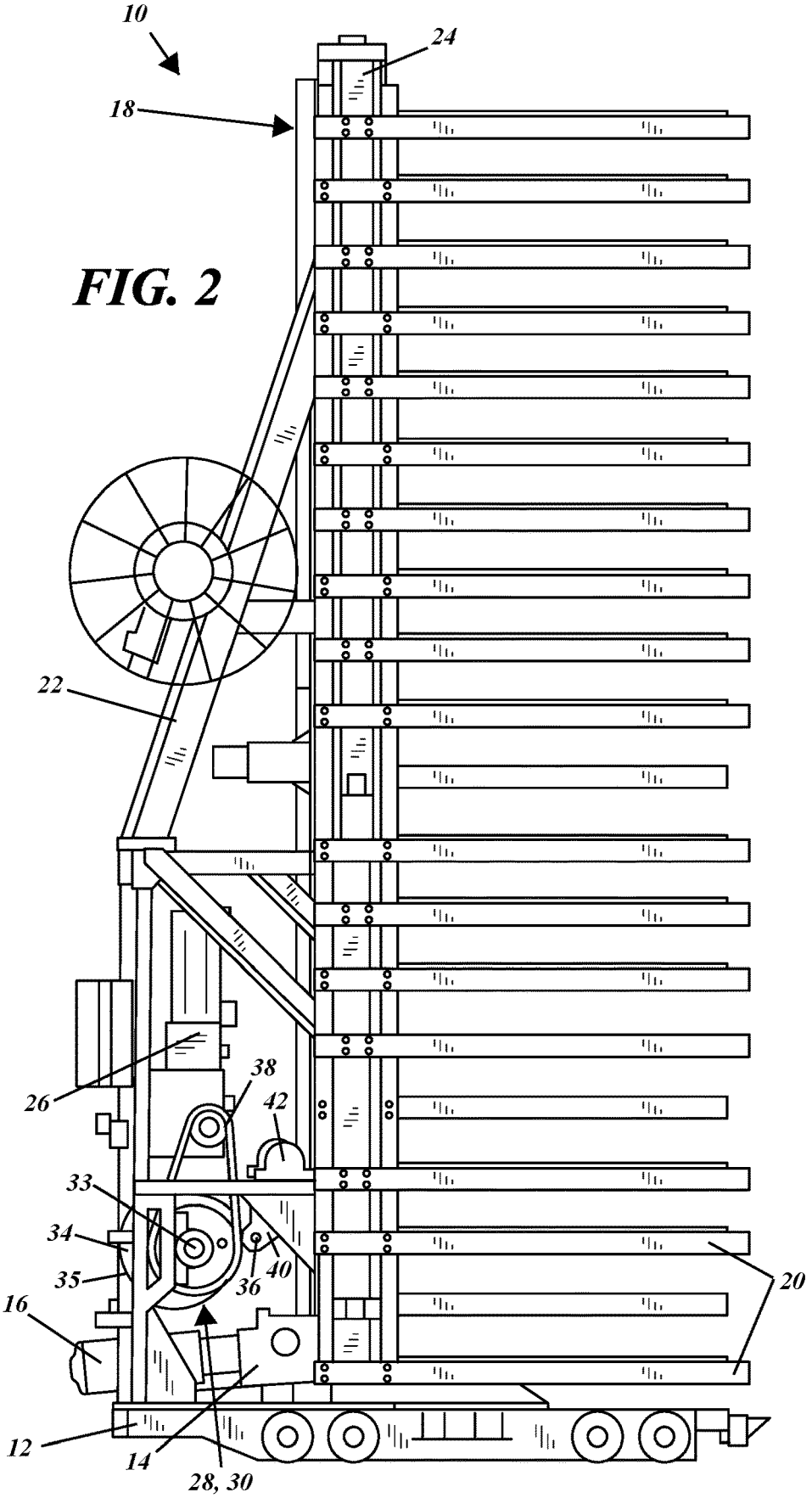
FIG. 2 is a side view taken in a direction opposite the side perspective view of the pallet transportation apparatus of FIG. 1.

A pallet transportation apparatus is generally shown at 10 in FIGS. 1 and 2. To provide mobility, the apparatus 10 comprises a mobile pallet transportation chassis 12, and the chassis 12 may carry a drive train 14 and a crawler motor 16 operatively connected to the drive train 14. The crawler motor 16 and drive train 14 may be configured to move the chassis 12 across a surface.

To move and store pallets, the apparatus 10 further includes a pallet support array 18 supported on the pallet transportation chassis 12 for reciprocal motion relative to the chassis 12 and comprising pallet supporters 20 spaced and shaped to receive and support pallets. A mast assembly 22 is fixed to the chassis 12 and includes guides 24 shaped to support and guide the pallet support array 18 through a reciprocal motion range causing the pallet support array 18 to lift and lower any pallets positioned to be carried by the pallet supporters 20.

The pallet supporters 20 of the pallet support array 18 may be positioned and linked for synchronized vertical motion so that multiple pallets may be lifted, and lowered simultaneously. And the pallet supporters 20 of the pallet support array 18 may be positioned in vertically-stacked pairs so that each pair may support a separate pallet. With this arrangement, multiple pallets may be lifted simultaneously from multiple shelves without requiring the pallets to rest on one another.

Figure 3:
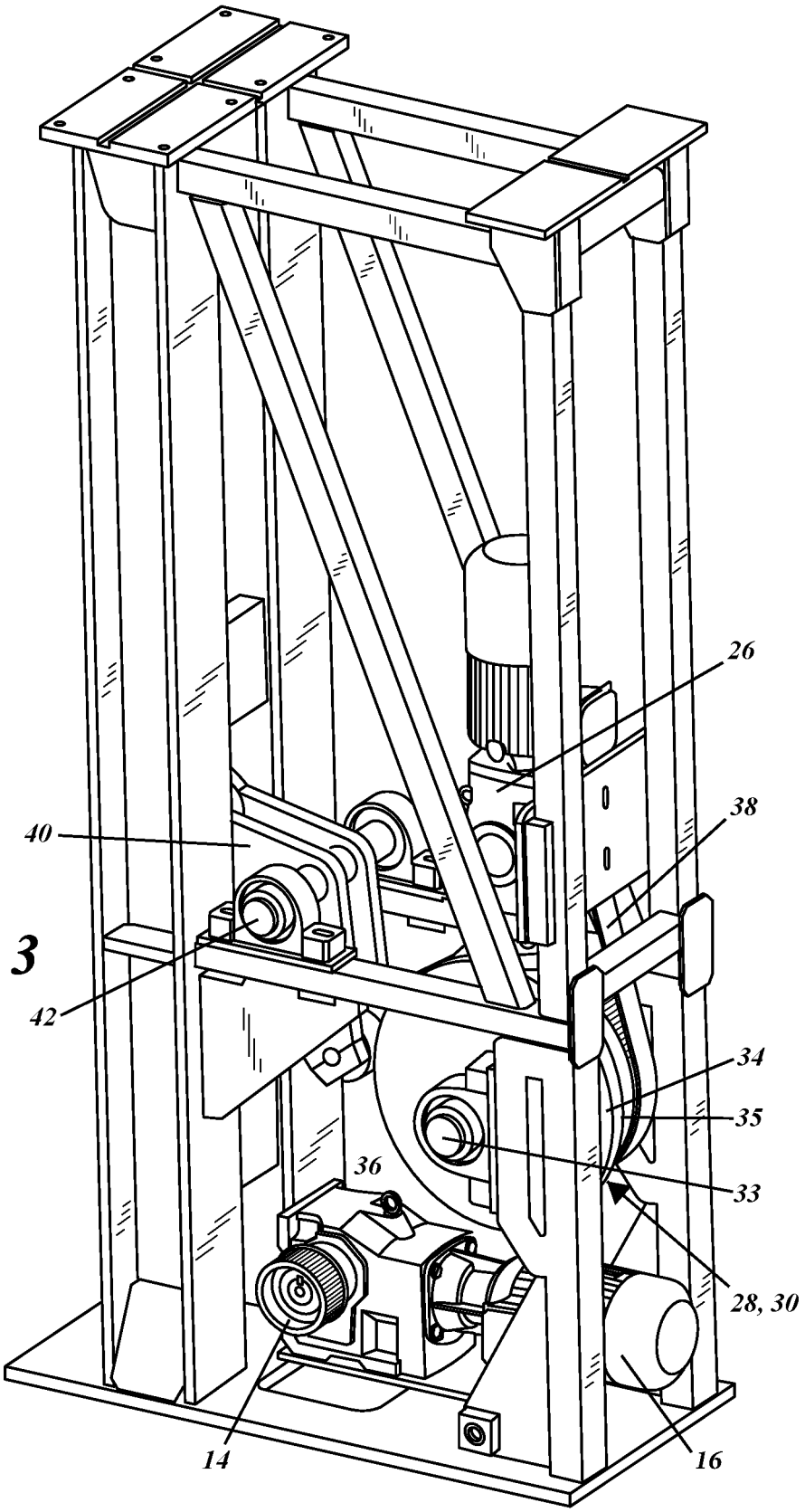
FIG. 3 is a perspective view of a lower part of a mast assembly of the pallet transportation apparatus of FIG. 1.
Figure 4:
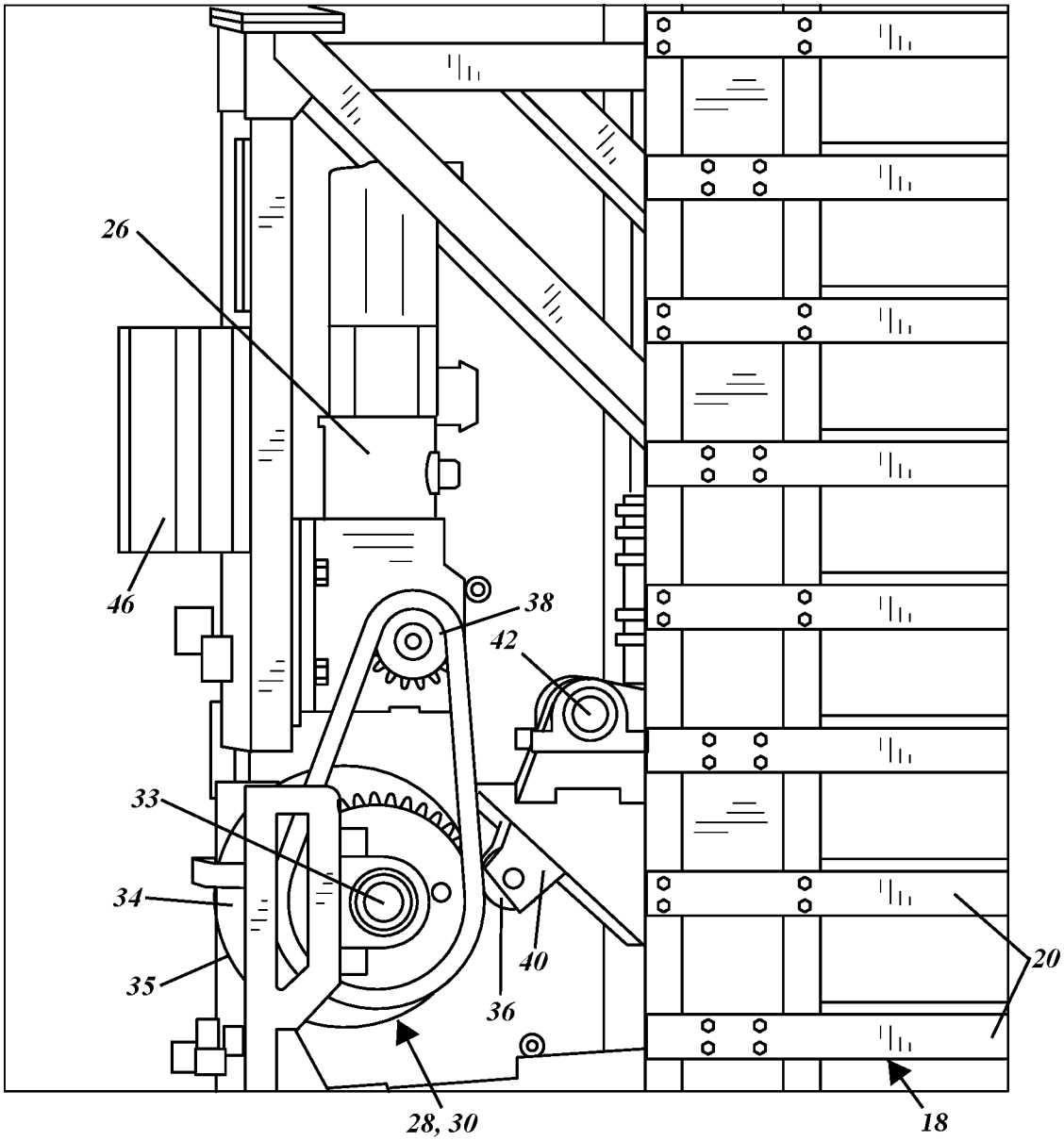
FIG. 4 is a closeup side view of a rotary cam motion control system for the apparatus of FIG. 1, with some supporting bracing of the mast assembly removed for clarity.
Figure 5:
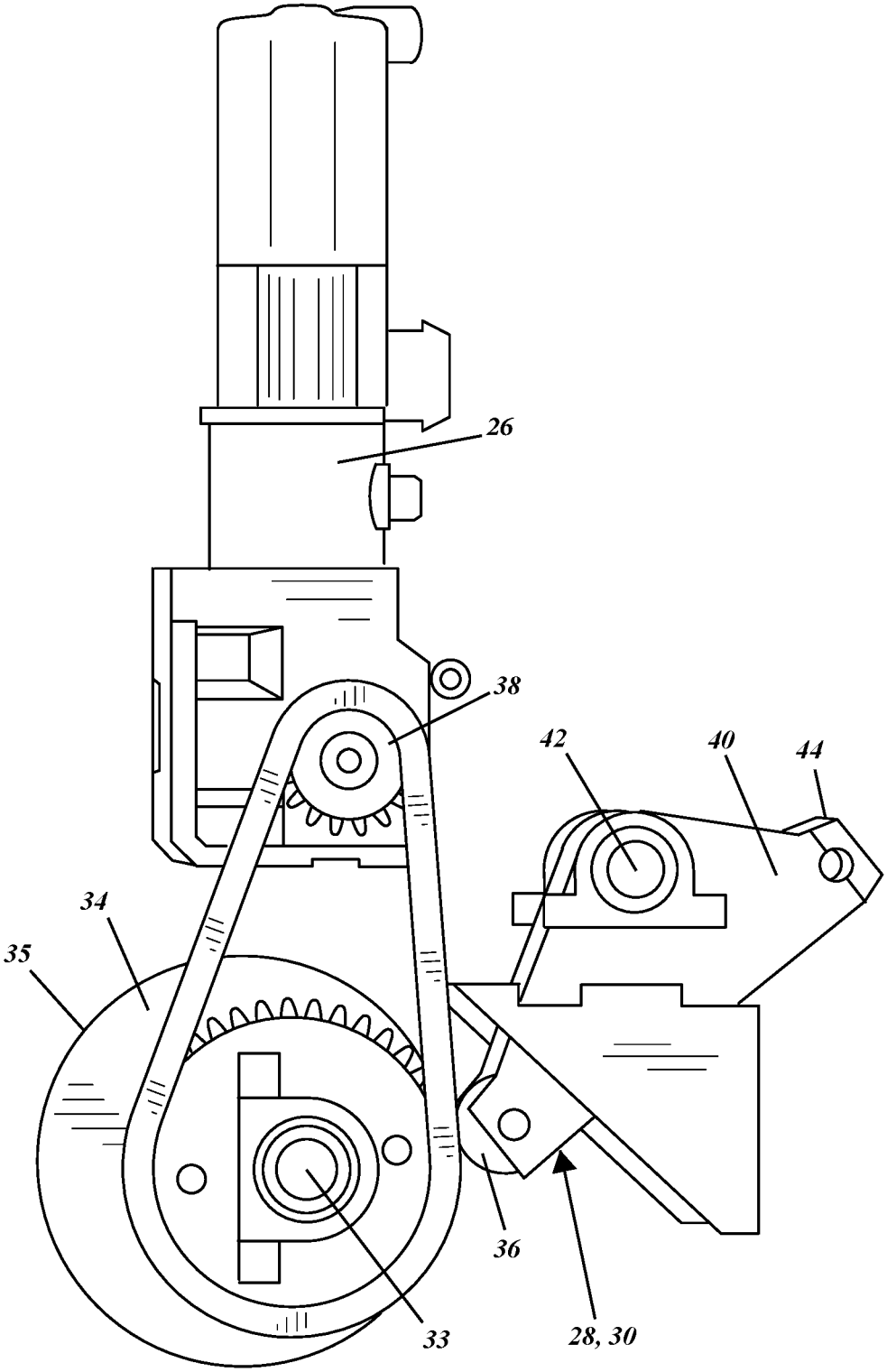
FIG. 5 is a simplified side view of a motor of the rotary cam motion control system of FIG. 1, shown removed from the apparatus for clarity.
Figure 6:
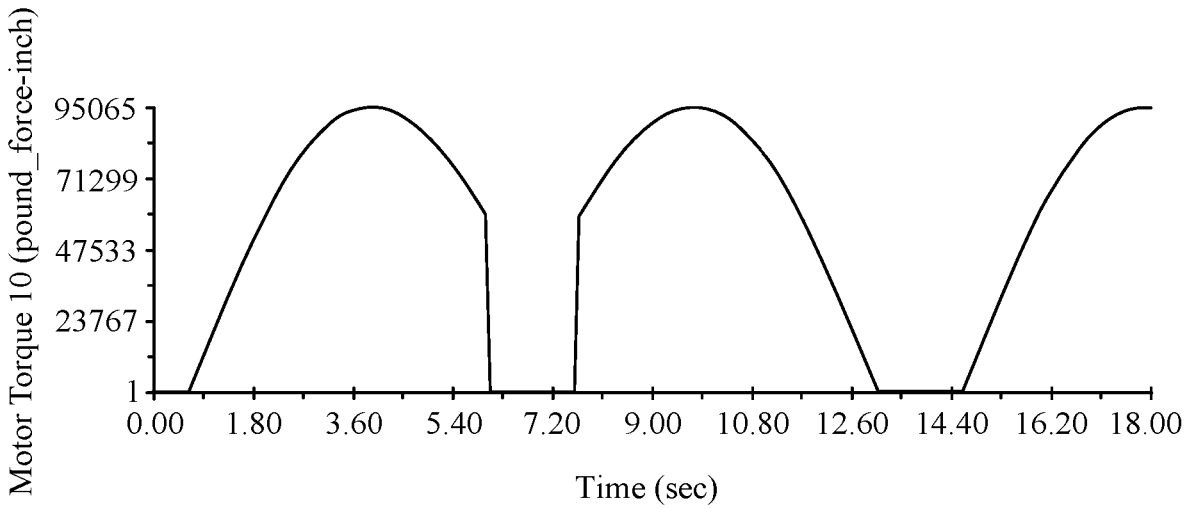
FIG. 6 is a chart showing a torque curve that the rotary cam of FIG. 1 requires over time when turned by a motor.
Figure 7:
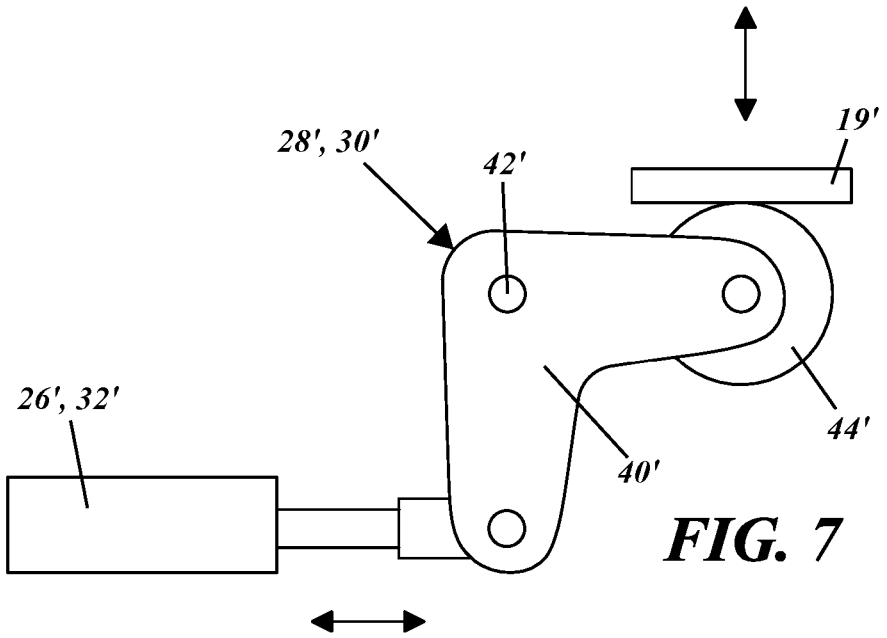
FIG. 7 is a simplified side view of an alternate motion control system for the apparatus of FIG. 1.

As best shown in FIGS. 3-5, a prime mover 26 (which may comprise a lift motor in a preferred embodiment) is carried by the chassis 12 and operatively connected to the pallet supporter array 18. The prime mover 26 is configured to move the pallet support array 18 through its reciprocal lifting and lowering motion. A motion control system 28 is connected to the prime mover 26 and configured to schedule the direction, velocity, and accelerations of the reciprocal lifting and lowering motion of the pallet support array 18 so that the velocities and accelerations of the pallet support array 18 and any supported pallets, corresponds to a distance that supported pallets are to be raised and/or lowered.

Where the prime mover 26 comprises a lift motor, it may comprise any sort of motor, including an electric motor configured to drive the reciprocal motion of the pallet support array 18 by applying torque to a mechanical linkage 30 operatively connecting the lift motor to the array 18. Alternatively, the prime mover 26' may be operatively connected to the pallet support array 18' and configured to drive the reciprocal motion of the pallet support array 18' by applying linear force to the array 18' (such as via a hydraulic circuit or worm drive 32') via the intervening linkage 30', as shown in FIG. 7. (Components of this embodiment are designated by the same number as analogous components of the preferred embodiment, albeit followed by a prime symbol. For example, bearing 42 of the embodiment shown in FIGS. 1-5 is analogous to bearing 42' of the embodiment shown in FIG. 7).

In the preferred embodiment, the motion control system 28 may comprise a mechanical linkage operatively connecting the prime mover 26 to the array 18, the linkage comprising a cam 34 driven by the prime mover 26 and shaped to schedule the reciprocal motion of the array 18 via motion of a cam follower 36 operatively connected to the array 18. The cam 34 may be a rotary cam, although other embodiments may use a sliding cam.

As best shown in FIG. 5, the rotary embodiment of the cam 34 may be coupled to the prime mover 26 via a chain and sprocket drive 38, and the rotary cam 34 may comprise a generally circular profile 35 mounted for rotation about an off-center cam rotational axis 33 so that the offset of the circular profile 35 corresponds to a desired profile for the reciprocal motion of the array 18. Alternatively, both the rotary and sliding cam types may have irregular profiles that correspond to a desired profile for the reciprocal motion of the array 18. These cam profiles may be customized and selected to produce desired motion profiles for pallets by changing and optimizing the range of motion or rate of motion of the support array 18 as it moves. This allows the system to be optimized for the payload type of the pallets and the distance that supported pallets are to be raised and/or lowered so that the pallets do not experience sudden starts and stops near the times when the reciprocal lifting and lowering causes the pallets to be picked up or set down by the pallet support array 18. Proper cam profiles may thereby be tailored to the mass or fragility of a given payload type to provide a desired balance of speedy operation, leverage, and careful handling; while protecting the apparatus 10, payloads, and nearby facilities from damage.

In some embodiments of the motion control system 28, the cam follower 36 may be carried by a lever arm 40 and fixed to the lever arm 40 at a distance from a lever arm bearing 42 that supports the lever arm 40 for rotation upon the pallet transportation chassis 12. The cam follower 36 may be located so that motion of the cam 34 will push the cam follower 36 and cause the lever arm 40 to rotate about the lever arm bearing 42. The lever arm 40 may further comprise a support array engagement surface 44 fixed to the lever arm 40 and located where it will engage the pallet support array 18, forcing the pallet support array 18 to raise or lower according to rotation of the lever arm 40 about the lever arm bearing 42.

In the embodiment shown in FIGS. 1-5, the lever arm 40 may form a generally triangle-shaped profile. In this triangle shape, the lever arm bearing 42, support array engagement surface 44, and cam follower 36 may be located adjacent the triangular lever arm's vertices, and the angular spacing between engagement surface 44, bearing 42, and cam follower 36 may vary in the same way as in the embodiment of FIG. 7.

In the alternative embodiment shown in FIG. 7, the lever arm 40' may generally comprise an L shape. The prime mover 26' may connect to the lever arm 40' at a first end of the L, the support array engagement surface 44 may be located at a second end of the L, and the lever arm bearing 42 may be located at the corner of the L. In this embodiment of lever arm 40', the engagement surface 44' comprises a roller that supports a lifting plate 19' component of the support array 18. The lever arm 40' may preferably have a roughly 90-degree L shape, but any angle of lever arm may be used to accommodate different prime mover 26' and/or cam 34 mounting locations.

Lever arm shapes may also be chosen to meet optimal leverage requirements in any embodiment—for example, the angle of the L shape may be increased or decreased to change the amount of torque required to move the support array 18 at various points along its range of motion, or to change the acceleration of the array 18 relative to the lift motor's speed at different points along the array's range of motion.

The motion control system 28 may also comprise a prime mover controller 46 configured to modulate the output of the prime mover 26 (for example, where the prime mover 26 is a servomotor) so that it varies the vertical speed of the pallets corresponding to the distance that the pallet has been raised and/or lowered. The controller may also or alternatively modulate prime mover 26 power to maintain RPM or motor speed in spite of varying resistance imposed by payload weight, cam shape, and/or lever arm geometry. This controller 46 may work in combination with the lever arm 40 and/or cam 34 to produce a reciprocal motion profile optimized to suit various payload types.

For example, and as shown in FIG. 5, the cam 34 and follower 36 may be indexed (by adjusting mounting locations and lever arm 40 shape) so that the cam follower 36 rests on the cam's profile 35 at a point where the radial distance is at a minimum between the cam profile 35 and the cam rotational axis 33, when the lever arm's pallet support array engagement surface 44 is generally horizontal to the lever arm bearing 42. This indexing arrangement allows motion of the pallet support array 18 to be slowed near the upper and lower limits of its travel if the lift motor 26 is run at a constant speed, preventing sudden stops, starts, and changes of direction as the apparatus 10 lifts or deposits pallets.

A pallet transportation apparatus constructed with these features can be configured to load and unload pallets via reciprocating motions having desired acceleration, leverage, and range of motion profiles suited to the mass, fragility, or other aspects of a particular type of payload.

This description, rather than describing limitations of an invention, only illustrates embodiments of the invention recited in the claims. The language of this description is therefore exclusively descriptive and is non-limiting. Obviously, it's possible to modify this invention from what the description teaches. Within the scope of the claims, one may practice the invention other than as described above.

What is claimed is:

1. A pallet transportation apparatus comprising:

a mobile pallet transportation chassis;

a pallet support array supported on the pallet transportation chassis for reciprocal motion relative to the chassis and comprising pallet supporters spaced and shaped to receive and support pallets;

a mast assembly fixed to the chassis and including guides shaped to support and guide the pallet support array through a reciprocal lifting and lowering motion causing the pallet support array to lift and lower any pallets positioned to be carried by the pallet supporters;

a prime mover carried by the chassis and operatively connected to the pallet supporter array and configured to move the pallet support array through its reciprocal lifting and lowering motion; and a motion control system connected to the prime mover and configured to schedule the direction, velocity, and accelerations of the reciprocal lifting and lowering motion of the pallet support array so that the velocities and accelerations of the pallet support array and any supported pallets, are optimized for the payload type of the pallets and the distance that supported pallets are to be raised and/or lowered.

2. The pallet transportation apparatus of claim 1 in which the pallet supporters of the pallet support array are positioned and linked for synchronized vertical motion to lift and lower multiple pallets simultaneously.

3. The pallet transportation apparatus of claim 2 in which the pallet supporters of the pallet support array are positioned in vertically-stacked pairs so that each pair may support a different pallet.

4. The pallet transportation apparatus of claim 1 in which the prime mover comprises an electric motor.

5. The pallet transportation apparatus of claim 1 in which the prime mover comprises a hydraulic pump operatively connected to the pallet supporter array via a hydraulic circuit.

6. The pallet transportation apparatus of claim 1 in which the prime mover is configured to drive the reciprocal motion of the pallet support array by applying linear force to a mechanical linkage operatively connecting the prime mover to the array.

7. The pallet transportation apparatus of claim 1 in which the prime mover is configured to drive the reciprocal motion of the pallet support array by applying torque to a mechanical linkage operatively connecting the prime mover to the array.

8. A pallet transportation apparatus comprising:

a mobile pallet transportation chassis;

a pallet support array supported on the pallet transportation chassis for reciprocal motion relative to the chassis and comprising pallet supporters spaced and shaped to receive and support pallets;

a mast assembly fixed to the chassis and including guides shaped to support and guide the pallet support array through a reciprocal lifting and lowering motion causing the pallet support array to lift and lower any pallets positioned to be carried by the pallet supporters;

a prime mover carried by the chassis and operatively connected to the pallet supporter array and configured to move the pallet support array through its reciprocal lifting and lowering motion, and a motion control system connected to the prime mover and configured to schedule the reciprocal lifting and lowering motion of the pallet support array:

the motion control system comprising a mechanical linkage operatively connecting the prime mover to the array, the linkage comprising a cam driven by the prime mover and shaped to schedule the reciprocal motion of the array via motion of a cam follower operatively connected to the array.

9. The pallet transportation apparatus of claim 8 in which the cam is a rotary cam.

10. The pallet transportation apparatus of claim 9 in which the rotary cam is coupled to the prime mover via a chain and sprocket.

11. The pallet transportation apparatus of claim 9 in which the rotary cam comprises a generally circular profile mounted for rotation about an off-center cam rotational axis so that offset of the circular profile corresponds to a desired profile for the reciprocal motion of the array.

12. The pallet transportation apparatus of claim 9 in which the rotary cam comprises a generally oblong profile having variations from a circular profile that correspond to a desired profile for the reciprocal motion of the array.

13. The pallet transportation apparatus of claim 8 in which;

the cam follower is carried by a lever arm supported upon the pallet transportation chassis for rotation about a lever arm axis;

the cam follower is fixed to the lever arm at a distance from the lever arm bearing and located so that motion of the cam will push the cam follower and cause the lever arm to rotate about the lever arm axis; and a support array engagement surface is fixed to the lever arm and located where it will engage the pallet support array and cause the pallet support array to raise or lower according to rotation of the lever arm about the lever arm axis.

14. The pallet transportation apparatus of claim 13 in which:

the lever arm comprises a generally triangular shape;

the cam follower is located adjacent a first corner of the triangular shape;

the support array engagement surface is located adjacent a second corner of the triangular shape; and the lever arm bearing is located adjacent a third corner of the triangular shape.

15. The pallet transportation apparatus of claim 13 in which the cam and follower are indexed such that the cam follower contacts a location along a profile of the cam where distance between the cam profile and the cam rotational axis is at a minimum when the lever arm's pallet support array engagement surface is disposed generally horizontal to the lever arm bearing.

16. A pallet transportation apparatus comprising:

a mobile pallet transportation chassis;

a pallet support array supported on the pallet transportation chassis for reciprocal motion relative to the chassis and comprising pallet supporters spaced and shaped to receive and support pallets;

a mast assembly fixed to the chassis and including guides shaped to support and guide the pallet support array through a reciprocal lifting and lowering motion causing the pallet support array to lift and lower any pallets positioned to be carried by the pallet supporters;

a prime mover carried by the chassis and operatively connected to the pallet supporter array and configured to move the pallet support array through its reciprocal lifting and lowering motion; and a motion control system connected to the prime mover and configured to schedule the reciprocal lifting and lowering motion of the pallet support array:

the motion control system comprising a mechanical linkage operatively connecting the prime mover to the array, the linkage comprising:

a lever arm supported upon the pallet transportation chassis for rotation about a lever arm axis; and a support array engagement surface fixed to the lever arm and located where it will engage the pallet support array and cause the pallet support array to raise or lower according to rotation of the lever arm about the lever arm axis.

17. The pallet transportation apparatus of claim 16 in which:

the lever arm comprises an L shape;

the prime mover is connected to the lever arm adjacent a first end of the L;

the support array engagement surface comprises a roller located adjacent a second end of the L; and the lever arm bearing is located adjacent the corner of the L.

18. The pallet transportation apparatus of claim 8 in which the motion control system comprises a prime mover controller configured to modulate the output of the prime mover so that it varies the vertical speed of the pallets corresponding to the distance that the pallet has been raised and/or lowered.

19. The pallet transportation apparatus of claim 1 additionally comprising:

a crawler motor carried by the chassis; and a drive train carried by the chassis and operatively connected to the crawler motor, the crawler motor and drive train being configured to move the chassis across a surface.

* * * * *